US011293103B2

(12) United States Patent
Tsuchimoto et al.

(10) Patent No.: US 11,293,103 B2
(45) Date of Patent: Apr. 5, 2022

(54) HIGH-STRENGTH COLD-ROLLED STEEL SHEET

(71) Applicant: JFE STEEL CORPORATION, Tokyo (JP)

(72) Inventors: Kazuaki Tsuchimoto, Tokyo (JP); Shinji Otsuka, Tokyo (JP); Kentaro Hata, Tokyo (JP); Akira Matsuzaki, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 16/476,181

(22) PCT Filed: Dec. 15, 2017

(86) PCT No.: PCT/JP2017/045157
§ 371 (c)(1),
(2) Date: Jul. 5, 2019

(87) PCT Pub. No.: WO2018/128067
PCT Pub. Date: Jul. 12, 2018

(65) Prior Publication Data

US 2020/0024742 A1 Jan. 23, 2020

(30) Foreign Application Priority Data

Jan. 5, 2017 (JP) ..... JP2017-000526

(51) Int. Cl.
*C23C 22/06* (2006.01)
*C22C 38/00* (2006.01)
(Continued)

(52) U.S. Cl.
CPC ..... *C23C 22/42* (2013.01); *C22C 38/002* (2013.01); *C22C 38/02* (2013.01); *C22C 38/04* (2013.01); *C23C 22/74* (2013.01)

(58) Field of Classification Search
CPC ..... C22C 38/002; C22C 38/02; C22C 38/04; C22C 38/00; C23C 22/42; C23C 22/74
See application file for complete search history.

(56) References Cited

U.S. PATENT DOCUMENTS

| | | | | |
|---|---|---|---|---|
| 4,863,516 | A | 9/1989 | Mosser et al. | |
| 2012/0118437 | A1 | 5/2012 | Wang et al. | |
| 2013/0087257 | A1* | 4/2013 | Yoshino | C21D 8/005 148/648 |

FOREIGN PATENT DOCUMENTS

| | | | |
|---|---|---|---|
| CN | 1826221 | A | 8/2006 |
| CN | 101235498 | A | 8/2008 |

(Continued)

OTHER PUBLICATIONS

Jun. 10, 2020 Office Action issued in European Patent Application No. 17 890 463.7.

(Continued)

*Primary Examiner* — Daniel J. Schleis
*Assistant Examiner* — Kevin Ct Li
(74) *Attorney, Agent, or Firm* — Oliff PLC

(57) ABSTRACT

A steel sheet mainly suitable for strength members of automobiles or building materials, which has a tensile strength of 1,180 MPa or more, and which is excellent in delayed fracture resistance and primary rust prevention performance. The steel sheet includes a coating, placed on a surface of a cold-rolled steel sheet with a tensile strength of 1,180 MPa or more, containing one or more metalates selected from molybdates and tungstates and a P compound. The sum of the coating weights of the metalates in terms of Mo and W is 10 mg/m$^2$ to 1,000 mg/m$^2$ and is preferably 50 mg/m$^2$ to 1,000 mg/m$^2$. The coating weight of the P compound in terms of P is 10 mg/m$^2$ to 1,000 mg/m$^2$.

4 Claims, 1 Drawing Sheet

(51) Int. Cl.

| | |
|---|---|
| ***C22C 38/04*** | (2006.01) |
| ***C23C 22/42*** | (2006.01) |
| ***C22C 38/02*** | (2006.01) |
| ***C23C 22/74*** | (2006.01) |

(56) References Cited

FOREIGN PATENT DOCUMENTS

| | | | |
|---|---|---|---|
| CN | 102725431 | A | 10/2012 |
| CN | 105420469 | A | 3/2016 |
| EP | 2530177 | A1 | 12/2012 |
| EP | 2 589 674 | A1 | 5/2013 |
| JP | H06-346229 | A | 12/1994 |
| JP | 2003-41384 | A | 2/2003 |
| JP | 2004-231992 | A | 8/2004 |
| JP | 2006-124797 | A | 5/2006 |
| JP | 2006-291288 | A | 10/2006 |
| JP | 2006291288 | A * | 10/2006 |
| JP | 2010-163684 | A | 7/2010 |
| JP | 2010163684 | A * | 7/2010 |
| JP | 2013-163827 | A | 8/2013 |
| JP | 2015-224367 | A | 12/2015 |
| JP | 2015224367 | A * | 12/2015 |
| JP | 2016-160507 | A | 9/2016 |

OTHER PUBLICATIONS

Sep. 13, 2019 Extended Search Report issued in European Patent Application No. 17890463.7.

Feb. 13, 2018 International Search Report issued in PCT/JP2017/045157.

Feb. 2, 2021 Office Action issued in Korean Patent Application No. 10-2019-7018306.

Sep. 28, 2020 Office Action issued in Chinese Patent Application No. 201780082108.1.

* cited by examiner

HIGH-STRENGTH COLD-ROLLED STEEL SHEET

TECHNICAL FIELD

This application relates to steel sheets excellent in delayed fracture resistance. The application particularly relates to a high-tensile strength steel sheet which is a steel sheet mainly suitable for strength members of automobiles or building materials, which is required to have delayed fracture resistance, and which has a tensile strength of 1,180 MPa (about 120 kgf/mm$^2$) or more.

BACKGROUND

Hitherto, cold-rolled steel sheets have been used as steel sheets for automobiles from requirements on the accuracy of the thickness and the flatness. In recent years, from the viewpoint of reducing automotive $CO_2$ emissions and the viewpoint of ensuring safety, increasing the strength of steel sheets for automobiles is development.

However, it is known that increasing the strength of steel is likely to cause a phenomenon called delayed fracture. This phenomenon becomes more serious with an increase in strength and is significant particularly for high-strength steel with a tensile strength of 1,180 MPa or more. Incidentally, delayed fracture is a phenomenon in which brittle fracture with little apparent plastic deformation suddenly happen on high-strength steel after a certain period of time has passed from when high-strength steel starts to be subjected to static load stress (load stress is lower than or equal to the tensile strength).

It is known that the delayed fracture is caused by the residual stress and the hydrogen embrittlement. The residual stress is generated when a steel sheet is formed into a predetermined shape at press working process. The hydrogen embrittlement generates in such a stress-concentrated portion of the steel. In most cases, hydrogen, which causes the hydrogen embrittlement, penetrates into steel from an outside environment and probably diffuses thereinto. Typically, hydrogen penetrating into steel in association with corrosion is cited.

In order to prevent the delayed fracture of a high-strength steel sheet, it has been studied that the microstructure or components of a steel sheet is adjusted such that the delayed fracture susceptibility thereof is reduced as described in, for example, Patent Literature 1. However, in the case using such a technique, the amount of hydrogen penetrating into a steel sheet from an outside environment is not reduced and the delayed fracture itself cannot be suppressed, even if the occurrence of the delayed fracture can be delayed. That is, in order to essentially improve the delayed fracture, the amount of hydrogen penetrating into the steel sheet needs to be controlled. From such a viewpoint, Patent Literature 2 discloses a technique in which delayed fracture is suppressed in such a manner that the amount of hydrogen penetrating into a steel sheet is reduced by plating a cold-rolled steel sheet with Ni or a Ni-based alloy. Furthermore, Patent Literature 3 discloses a technique in which delayed fracture is suppressed in such a manner that hydrogen is prevented from penetrating into a steel sheet by forming a coating (a plated coating, a chemical conversion coating, or the like) containing hydrogen-absorbing particles, such as Ti, dispersed therein on a surface of the steel sheet.

CITATION LIST

Patent Literature

PTL 1: Japanese Unexamined Patent Application Publication No. 2004-231992

PTL 2: Japanese Unexamined Patent Application Publication No. 6-346229

PTL 3: Japanese Unexamined Patent Application Publication No. 2003-41384

SUMMARY

Technical Problem

However, in the case where a steel sheet is electroplated with Ni or a Ni-based alloy as described in Patent Literature 2, hydrogen generated during plating probably remains in the steel sheet to cause delayed fracture. Furthermore, in the case where a surface-plated steel sheet is subjected to press working, the adhesion between a coated layer and the steel sheet is weak, the coated layer is damaged during working and thereby the desired characteristic cannot be obtained in a high possibility. In a technique in which hydrogen is trapped with a coating on a surface of a steel sheet as described in Patent Literature 3, although the penetration of hydrogen can be suppressed in the initial stage of corrosion, delayed fracture is probably caused when the amount of penetrating hydrogen exceeds the absorption capacity.

In order to use a steel sheet for automobiles, not only delayed fracture resistance but also excellent primary rust prevention performance is needed.

Accordingly, it is an object of the disclosed embodiments to provide a steel sheet mainly suitable for strength members of automobiles or building materials and the steel sheet solves problems of the above prior techniques and has a tensile strength of 1,180 MPa or more and excellent in delayed fracture resistance and primary rust prevention performance.

Solution to Problem

In order to solve the above problems, the inventors have investigated and researched solutions for preventing delayed fracture by preventing hydrogen from penetrating into a steel sheet. As a result, the inventors have found that a coating including a P compound and one or more metalates selected from molybdates and tungstates is formed on a surface of a cold-rolled steel sheet and thereby the amount of hydrogen penetrating into a steel sheet can be significantly reduced and the delayed fracture of the steel sheet can be effectively suppressed. At the same time, it has become clear that excellent primary rust prevention performance can be exhibited.

The disclosed embodiments have been made on the basis of the above finding and is as summarized below.

[1] A high-strength cold-rolled steel sheet includes a coating, placed on a surface of a cold-rolled steel sheet with a tensile strength of 1,180 MPa or more, containing a P compound and one or more metalates selected from molybdates and tungstates. The sum of the coating weights of the metalates in terms of metal (Mo, W) is 10 mg/m$^2$ to 1,000 mg/m$^2$. The coating weight of the P compound in terms of P is 10 mg/m$^2$ to 1,000 mg/m$^2$.

[2] In the high-strength cold-rolled steel sheet specified in Item [1], the sum of the coating weights of the metalates in terms of metal (Mo, W) is 50 mg/m$^2$ to 1,000 mg/m$^2$.

Advantageous Effects

A steel sheet according to the disclosed embodiments is a steel sheet having a tensile strength of 1,180 MPa or more, has excellent delayed fracture resistance such that delayed fracture is effectively suppressed, and further has excellent primary rust prevention performance. Therefore, high-strength members can be used for automobiles and building materials, thereby enabling the weight reduction thereof to be reduced.

DETAILED DESCRIPTION

Figure 1:
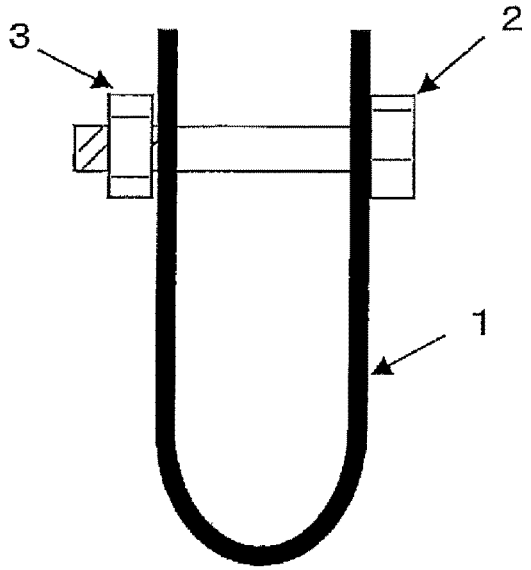
FIG. 1 is a schematic view of a specimen, used in an example according to an embodiment, for delayed fracture evaluation.

In steel sheets excellent in delayed fracture resistance according to the disclosed embodiments, steel sheets (base steel sheets) serving as substrates have no particular limitation on the chemical composition, the metallographic microstructure, a rolling method, or the like and may be arbitrary ones. Among them, cold-rolled steel sheets which are used in the automotive field and the building material field and which are often used particularly in the automotive field are preferable. In particular, a high-tensile strength cold-rolled steel sheet, having a tensile strength of 1,180 MPa (about 120 kgf/mm$^2$) or more, concerned about the occurrence of delayed fracture under an air corrosion environment is important. Even if the disclosed embodiments are applied to a steel sheet with a tensile strength of less than 1,180 MPa and a coating containing a specific metalate and a P compound is formed on a surface thereof, various properties of the steel sheet are not affected. However, steel sheets with low tensile strength are unlikely to have delayed fracture, forming a coating according to the disclosed embodiments leads to an increase in cost.

In high-strength cold-rolled steel sheets, the following modifications are applied alone or in combination for the purpose of enhancing properties such as mechanical properties. The modification are, for example, microstructural or structural modifications such as solid solution hardening by the addition of an interstitial solute element such as C or N or a substitutional solute element such as Si, Mn, P, or Cr; precipitation hardening by a carbide or nitride of Ti, Nb, V, or the like; chemical compositional modifications by the addition of a strengthening element such as W, Zr, Hf, Co, B, a rare-earth element, or the like; hardening by recovery annealing at a temperature at which crystallization does not occur or partial recrystallization hardening allowing an unrecrystallized region to remain without recrystallization; hardening due to a transformation microstructure by forming a bainite or martensite single phase or a composite microstructure of ferrite and these transformation microstructures; grain refinement hardening given by the Hall-Petch equation $\sigma=\sigma_0+kd^{-1/2}$ (where $\sigma$: stress, $\sigma_0$, k: material constant) when d is the ferrite grain size; and work hardening by rolling or the like. The chemical composition and metallographic microstructure of a steel sheet used in the disclosed embodiments are not particularly limited as described above and one having a predetermined tensile strength may have any chemical composition and metallographic microstructure.

Examples of the composition of such a high-strength cold-rolled steel sheet include, but are not limited to, one containing C: 0.1 mass % to 0.4 mass %, Si: 0 mass % to 2.5 mass %, Mn: 1 mass % to 3 mass %, P: 0 mass % to 0.05 mass %, and S: 0 mass % to 0.005 mass %, the remainder being Fe and inevitable impurities; those obtained by adding one or more of Cu, Ti, V, Al, and Cr to this; and the like.

Commercially available examples of the high-strength cold-rolled steel sheet include, but are not limited to, JFE-CA1180, JFE-CA1370, JFE-CA1470, JFE-CA1180SF, JFE-CA1180Y1, JFE-CA1180Y2 (the above being manufactured by JFE Steel Corporation), SAFC1180D (manufactured by NIPPON STEEL & SUMITOMO METAL CORPORATION), and the like.

The thickness of a cold-rolled steel sheet serving as a substrate is not particularly limited, is preferably, for example, about 0.8 mm to 2.5 mm, and is more preferably about 1.2 mm to 2.0 mm.

A steel sheet excellent in delayed fracture resistance according to the disclosed embodiments includes a coating, placed on a surface of the above cold-rolled steel sheet, containing a P compound and one or more metalates selected from molybdates and tungstates.

Examples of the molybdates include sodium molybdate, ammonium molybdate, sodium phosphomolybdate, and the like. Examples of the tungstates include sodium tungstate, potassium tungstate, zirconium tungstate, and the like. In the disclosed embodiments, as one or more selected from the molybdates and the tungstates, one or more of these may be contained.

Examples of the P compound include phosphoric acid, pyrophosphoric acid, phosphoric acid, hypophosphorous acid, and the like. In the disclosed embodiments, as the P compound, one or more of these may be contained.

The sum of the coating weights of the metalates in the coating in terms of metal (Mo, W) is set to 10 mg/m$^2$ to 1,000 mg/m$^2$. When the coating weight is less than 10 mg/m$^2$, the effect of reducing the amount of generated hydrogen is low and no delayed fracture resistance can be exhibited. From this viewpoint, the lower limit of the coating weight is preferably 50 mg/m$^2$. On the other hand, when the coating weight is more than 1,000 mg/m$^2$, costs are high, though a function for delayed fracture resistance does not decrease. This is not preferable. From this viewpoint, the upper limit of the coating weight is preferably 500 mg/m$^2$.

The coating weight of the P compound in the coating in terms of P is set to 10 mg/m$^2$ to 1,000 mg/m$^2$. When the coating weight is less than 10 mg/m$^2$, the formation of a reaction layer with the steel sheet is not sufficient and therefore there is no visible improvement in delayed fracture resistance over a long period of time. In consideration of the formation of the reaction layer, the lower limit of the coating weight is preferably 50 mg/m$^2$. On the other hand, when the coating weight is more than 1,000 mg/m$^2$, costs are high, though a function for delayed fracture resistance does not decrease. This is not preferable. From this viewpoint, the upper limit of the coating weight is preferably 500 mg/m$^2$. Incidentally, the coating weight of each metal component in the coating is measured by a method described in an example.

In the disclosed embodiments, reasons why the delayed fracture resistance is improved by forming the coating, which contains the P compound and one or more metalates selected from the molybdates and the tungstates and, are not necessarily clear but are probably due to a mechanism below.

In the course of dry/wet corrosion, a hydrogen generation reaction among cathodic reactions is dominant in an acidic region and therefore the amount of generated hydrogen increases. As a result, the amount of hydrogen penetrating into the steel sheet increases to cause delayed fracture. On the other hand, it is known that the molybdates and the tungstates are present in the form of having a double bond with oxygen and therefore have an easily reducible nature. Therefore, it is conceivable that, since the coating, which contains the above-mentioned metalates, is present on a surface layer, a portion of the cathodic reactions is consumed in reducing components (metalates) and therefore the amount of generated hydrogen decreases. Hence, it is conceivable that the amount of hydrogen penetrating into the steel sheet decreases, resulting in an improvement in delayed fracture resistance.

Furthermore, since the coating contains the P compound and therefore forms the reaction layer with a surface of the steel sheet, the coating can be made strong. Although the molybdates and the tungstates have the effect of reducing the amount of penetrating hydrogen in the course of corrosion as described above, the molybdates and the tungstates alone have low water resistance and therefore the coating is dissolved during moistening in a corrosion test; hence, there is no visible improvement in delayed fracture resistance over a long period of time. However, since the P compound is contained, excellent delayed fracture resistance is obtained over a long period of time. At the same time, excellent primary rust prevention performance can be obtained by forming the coating, which is strong, on a surface of the steel sheet.

A method for forming the coating on a surface of the cold-rolled steel sheet is not particularly limited and is, for example, a method in which the cold-rolled steel sheet surface is coated with a surface treatment solution containing the above-mentioned components (the metalates and the P compound), followed by heating/drying. The surface treatment solution, which is coated on the cold-rolled steel sheet surface, can be prepared by dissolving or dispersing the above-mentioned components (the metalates and the P compound) in a solvent (water and/or an organic solvent).

A method for coating the cold-rolled steel sheet surface with the surface treatment solution may be any one of an application method, an immersion method, and a spraying method. In the application method, any one of coating means such as a roll coater (a three-roll method, a two-roll method, or the like), a squeeze coater, and a die coater may be used. The adjustment of the application quantity, the homogenization of the appearance, or the equalization of the thickness can be performed by an air knife method or a roll drawing method after application treatment, immersion treatment, or spraying treatment using a squeeze coater or the like.

After coating is performed using the surface treatment solution as described above, heating/drying is usually performed without water washing and may be performed after coating treatment. A method for heating/drying the coated surface treatment solution is arbitrary and, for example, a means such as a dryer, a hot blast stove, a high-frequency induction heater, or an infrared oven can be used. The heating/drying treatment is preferably performed at an attained temperature of 40° C. to 300° C., desirably within the range of 40° C. to 160° C. When the heating/drying temperature is lower than 40° C., the drying time is long and coating unevenness may possibly occur. However, when the heating/drying temperature is high, the strength is reduced by changing the material quality controlled in an annealing step or a function as an inherent high-strength steel may possibly be reduced. From this viewpoint, the heat treatment time is preferably short and the temperature range is preferably 300° C. or less.

EXAMPLES

The following sheets were used as base steel sheets: cold-rolled steel sheets (as-cold-rolled steel sheets), containing components such as C: 0.191 mass %, Si: 0.4 mass %, Mn: 1.56 mass %, P: 0.011 mass %, and S: 0.001 mass %, the remainder being Fe and inevitable impurities, having a tensile strength of 1,520 MPa and a thickness of 1.5 mm.

Oil sticking to surfaces of the cold-rolled steel sheet was ultrasonically removed using a mixture of toluene and ethanol. In a coating method, surface treatment solutions for forming coatings were prepared by dissolving blend components (metalates and P compounds) shown in Table 1 in water (pure water) and were applied to surfaces of the steel sheets, followed by heating/drying in a high-frequency induction heater, whereby steel sheets of Examples and Comparative Examples were obtained. The coating weight of each metal component in a corresponding one of the coatings was measured by X-ray fluorescence using steel sheets in which the coating weight of each metal component was known as reference sheets.

The steel sheets obtained in the above manner were evaluated for delayed fracture resistance by a technique below. The results are shown in Table 1 together with the coating configuration. Incidentally, a steel sheet (No. 1 which was a comparative example) provided with no coating was similarly evaluated for properties.

Evaluation of Delayed Fracture Resistance

Figure 2:
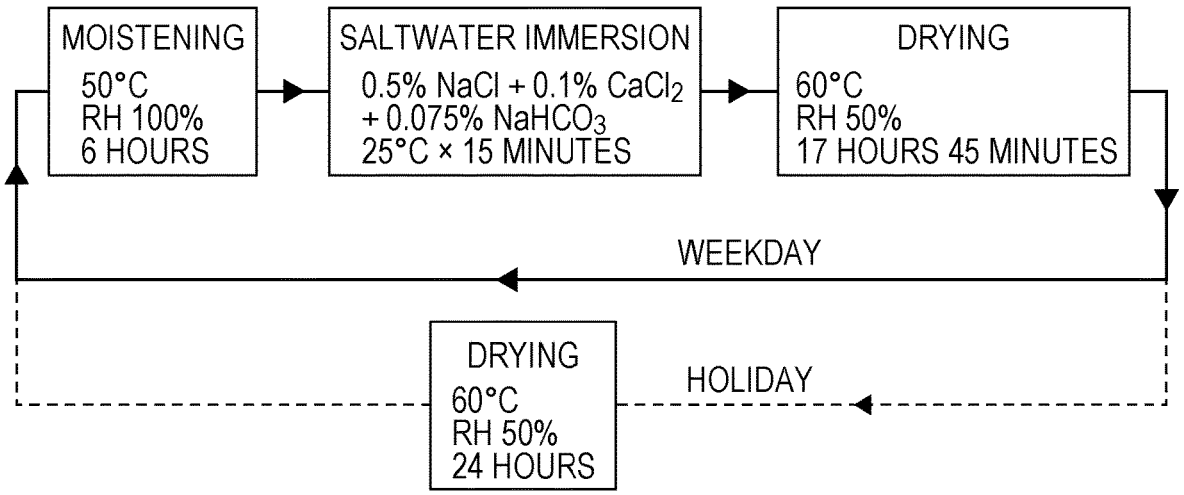
FIG. 2 is an illustration showing steps of a combined cyclic corrosion test performed in an example according to an embodiment.

The steel sheets of the Examples and Comparative Examples were sheared to a width of 35 mm and a length of 100 mm and were ground to a width of 30 mm, whereby specimens were obtained. As shown in FIG. 1, each specimen 1 was bent to a U-shape and was constrained with a bolt 2 and a nut 3 such that the shape of the specimen was fixed, whereby a specimen for delayed fracture evaluation was obtained. The specimen, prepared in this manner, for delayed fracture evaluation was subjected to a combined cyclic corrosion test (refer to FIG. 2), specified in SAE J2334 defined by Society of Automotive Engineers, including drying, moistening, and saltwater immersion steps up to 20 cycles. Whether cracking had occurred was visually checked before the saltwater immersion step of each cycle, whereby the number of cycles until the occurrence of cracking was measured. This test was performed for three samples of each steel sheet and the average thereof was used for evaluation. Evaluation was made on the basis of standards below from the number of cycles until the occurrence of cracking and a symbol (Good, Fair, or Poor) was given. As shown in Table 1, the case of the comparative example provided with no coating was four cycles; hence, the symbols "Good" and "Fair" were set to a preferable range. In Table 1, the fact that the number of cycles until the occurrence of cracking is 20 or more means that cracking did not occur in the results of the examples.

Good: 15 cycles or more

Fair: 10 cycles to less than 15 cycles

Poor: less than 10 cycles

Evaluation of Primary Rust Prevention Performance

The steel sheets of Examples and Comparative Examples were sheared to a size of 50 mm×50 mm. The specimens were subjected to the above combined cyclic corrosion test (refer to FIG. 2). Evaluation was made on the basis of standards below from the area fraction of red rust observed after the first cycle and a symbol (Good or Poor) was given. Incidentally, the symbol "Good" was set to a preferable range.

Good: the area fraction of observed red rust being less than 50%

Poor: the area fraction of observed red rust being 50% or more

TABLE 1

| | Coating configuration | | | | Delayed fracture resistance | | | |
|---|---|---|---|---|---|---|---|---|
| | Metalate | | P compound | | | | | |
| No. | Type | Coating weight *1 ($mg/m^2$) | Type | Coating weight *2 ($mg/m^2$) | Number of cycles until occurrence of cracking | Evaluation | Primary rust prevention performance | Category |
| 1 | — | — | — | — | 4 | Poor | Poor | Comparative example |
| 2 | Sodium molybdate | 5 | Phosphoric acid | 5 | 8 | Poor | Poor | Comparative example |
| 3 | Sodium molybdate | 10 | Phosphoric acid | 10 | 12 | Fair | Good | Example |
| 4 | Sodium molybdate | 10 | Phosphoric acid | 5 | 9 | Poor | Poor | Comparative example |
| 5 | Sodium molybdate | 50 | Phosphoric acid | 50 | 15 | Good | Good | Example |
| 6 | Sodium molybdate | 500 | Phosphoric acid | 500 | 19 | Good | Good | Example |
| 7 | Sodium phosphomolybdate | 200 | Phosphoric acid | 500 | 16 | Good | Good | Example |
| 8 | Ammonium molybdate | 1000 | Pyrophosphoric acid | 200 | 20 or more | Good | Good | Example |
| 9 | Sodium tungstate | 600 | Phosphoric acid | 1000 | 20 or more | Good | Good | Example |
| 10 | Calcium tungstate | 300 | Phosphoric acid | 500 | 18 | Good | Good | Example |
| 11 | Zirconium tungstate | 50 | Phosphoric acid | 500 | 15 | Good | Good | Example |

*1 The coating weight in terms of metal (Mo, W).
*2 The coating weight in terms of P.

In Table 1, Example Nos. 3 and 5 to 8 have a coating containing a molybdate and a P compound and Example Nos. 9 to 11 have a coating containing a tungstate and a P compound within the scope of the disclosed embodiments. All the examples according to disclosed embodiments are provided with excellent delayed fracture resistance and primary rust prevention performance.

The invention claimed is:

1. A high-strength cold-rolled steel sheet suitable for automobiles or building materials, the steel sheet comprising:

a cold-rolled steel sheet having a tensile strength of 1,180 MPa or more; and a coating disposed directly on and in direct contact with a surface of the cold-rolled steel sheet, the coating consisting essentially of a P compound and at least one metalate selected from the group consisting of molybdates and tungstates, wherein a sum of coating weight of the at least one metalate in terms of at least one of Mo and W is in a range of 10 $mg/m^2$ to 1,000 $mg/m^2$ and a coating weight of the P compound in terms of P is in a range of 10 $mg/m^2$ to 1,000 $mg/m^2$.

2. The high-strength cold-rolled steel sheet according to claim 1, wherein the sum of the coating weight of the at least one metalate in terms of Mo and W is in a range of 50 $mg/m^2$ to 1,000 $mg/m^2$.

3. The high-strength cold-rolled steel sheet according to claim 1, wherein the P compound is at least one selected from the group consisting of phosphoric acid, pyrophosphoric acid, phosphonic acid, and hypophosphorous acid, and the molybdates are at least one selected from the group consisting of sodium molybdate, ammonium molybdate, and sodium phosphomolybdate.

4. The high-strength cold-rolled steel sheet according to claim 1, wherein the P compound is at least one selected from the group consisting of phosphoric acid, pyrophosphoric acid, phosphonic acid, and hypophosphorous acid, and the tungstates are at least one selected from the group consisting of sodium tungstate, potassium tungstate, and zirconium tungstate.

* * * * *